US010086419B2

(12) United States Patent
Introini et al.

(10) Patent No.: US 10,086,419 B2
(45) Date of Patent: Oct. 2, 2018

(54) WINDING MACHINE FOR WRAPPING MULTIPLE COILS OF ROLLED MATERIAL AROUND A REEL

(71) Applicant: Primetals Technologies Austria GmbH, Linz (AT)

(72) Inventors: Mauro Introini, Cardano al Campo (IT); Emanuele Osto, Milan (IT); Francesco Toschi, San Donà di Piave (IT)

(73) Assignee: PRIMETALS TECHNOLOGIES AUSTRIA GMBH (AT)

( * ) Notice: Subject to any disclaimer, the term of this patent is extended or adjusted under 35 U.S.C. 154(b) by 0 days.

(21) Appl. No.: 15/119,513

(22) PCT Filed: Jan. 23, 2015

(86) PCT No.: PCT/EP2015/051407
§ 371 (c)(1),
(2) Date: Aug. 17, 2016

(87) PCT Pub. No.: WO2015/124383
PCT Pub. Date: Aug. 27, 2015

(65) Prior Publication Data

US 2017/0246671 A1 Aug. 31, 2017

(30) Foreign Application Priority Data

Feb. 21, 2014 (EP) ..... 14425017

(51) Int. Cl.
*B21C 47/00* (2006.01)
*B65H 54/02* (2006.01)
(Continued)

(52) U.S. Cl.
CPC ..... *B21C 47/006* (2013.01); *B21C 47/30* (2013.01); *B21C 47/32* (2013.01);
(Continued)

(58) Field of Classification Search
CPC ..... B65H 54/026; B65H 75/28; B65H 65/00; B65H 2701/36; B21C 47/006; B21C 47/32; B21C 47/3441
See application file for complete search history.

(56) References Cited

U.S. PATENT DOCUMENTS 6,318,660 B1 * 11/2001 Bordignon ..... B21C 47/30 242/362.2
7,246,767 B2 * 7/2007 Castellani ..... B21C 47/32 242/172
(Continued)

FOREIGN PATENT DOCUMENTS

CN 1832819 A 9/2006
CN 1921960 A 2/2007
(Continued)

OTHER PUBLICATIONS

International Search Report dated Apr. 10, 2015 issued in corresponding International patent application No. PCT/EP2015/051407.
(Continued)

*Primary Examiner* — William E Dondero
(74) *Attorney, Agent, or Firm* — Ostrolenk Faber LLP

(57) ABSTRACT

A winding machine (100; 100*a*, 100*b*) for wrapping strands of rolled material, such as a bar, a rod, wire or the like, around a reel into coils: a reel (50; 50*a*, 50*b*); a base flange (1) defining a first catching recess (6) intended to receive an end of a first strand (17; 17*a*, 17*b*); a first cover (9) movable between an open position leaving the first catching recess (6) exposed and a closed position covering the first catching recess (6) to form a closed passage for the end of the first strand (17; 17*a*, 17*b*) in order to secure the end of the first strand to the reel (50; 50*a*, 50*b*). At least a second element (2) defining a second catching recess (4); and at least a second cover (8) movable between an open position leaving the further catching recess (4) exposed and a closed position
(Continued)

covering the second catching recess (4) to form a closed passage for the end of a second strand (27; 27*a*, 27*b*) in order to secure the end of the second strand to the reel (50; 50*a*, 50*b*).

14 Claims, 8 Drawing Sheets

(51) Int. Cl.

| | |
|---|---|
| ***B21C 47/34*** | (2006.01) |
| ***B21C 47/32*** | (2006.01) |
| ***B65H 75/28*** | (2006.01) |
| ***B65H 65/00*** | (2006.01) |
| ***B21C 47/30*** | (2006.01) |

(52) U.S. Cl.
CPC ..... *B21C 47/3441* (2013.01); *B65H 54/026* (2013.01); *B65H 65/00* (2013.01); *B65H 75/28* (2013.01); *B65H 2701/36* (2013.01)

(56) References Cited

U.S. PATENT DOCUMENTS

| | | | | |
|---|---|---|---|---|
| 7,566,023 | B2 * | 7/2009 | Bordignon | B21C 47/323 242/476.6 |
| 7,604,196 | B2 * | 10/2009 | Bordignon | B21C 47/04 242/476.1 |
| 2007/0001049 | A1 | 1/2007 | Castellani | |
| 2008/0217456 | A1 * | 9/2008 | Bordignon | B21C 47/323 242/362.3 |
| 2008/0217463 | A1 * | 9/2008 | Bordignon | B21C 47/04 242/520 |
| 2008/0223969 | A1 * | 9/2008 | Bordignon | B21C 47/30 242/363 |
| 2012/0126050 | A1 | 5/2012 | Land | |
| 2013/0161430 | A1 | 6/2013 | Weissbrod | |

FOREIGN PATENT DOCUMENTS

| | | | |
|---|---|---|---|
| CN | 1997465 | A | 7/2007 |
| RU | 2007133825 | A | 3/2009 |
| WO | WO 2005/084843 | A1 | 9/2005 |
| WO | WO 2006/084564 | A1 | 8/2006 |

OTHER PUBLICATIONS

Chinese Office Action, dated May 2, 2018, issued in corresponding Chinese Patent Application No. 201580009592.6. Including English translation. Total 15 pages.

Notice of Allowance, dated Jul. 31, 2018, issued in corresponding Russian Patent Application No. 2016133966 with English translation.

* cited by examiner

WINDING MACHINE FOR WRAPPING MULTIPLE COILS OF ROLLED MATERIAL AROUND A REEL

CROSS REFERENCE TO RELATED APPLICATIONS

The present application is a 35 U.S.C. §§ 371 national phase conversion of PCT/EP2015/051407, filed on Jan. 23, 2015, which claims priority of European Patent Application No. 14425017.2, filed Feb. 21, 2014, the contents of which are incorporated by reference herein. The PCT International Application was published in the English language.

TECHNICAL BACKGROUND

The present invention relates to a winding machine for wrapping a multiplicity of coils of rolled material around the same reel and, more specifically, for wrapping at least two coils of rolled material around the same reel. The present invention also relates to an assembly comprising a rolling mill plant managing a multiplicity of strands and connected to such a winding machine.

When rolling small bar diameters, the hourly tonnage rate of the mill is limited by the maximum output speed of the last rolling stand, as the material flow rate is the product of the small bar cross section by the mill rolling speed.

In an attempt to optimize a single strand rolling process, known rolling mills have been arranged to consecutively serve a multiplicity of spooling stations. However, they serve in a way that only one spooling station at a time can be served, for instance thanks to a switching device placed between the rolling mill and the different spooling stations. In this configuration, for example, one first billet is rolled and one corresponding first coil is formed at one first spooling station. Then the switch is diverted to a subsequent, different second spooling station and a following second billet is rolled forming a coil at such second spooling station. Meanwhile the first coil which had been formed in the first spooling station is removed to ready the first spooling station for another cycle. However, the need for at least two spooling stations which, in turn, operate only alternatively, rather than simultaneously each time that a cycle has been completed, does not make this configuration efficient with respect to hourly production rate and to space required, because in the face of a single strand process, two spooling stations are still required.

State of the art rolling plants try to overcome such a limitation of the maximum output speed by rolling the smaller bar diameter in multiple strands in parallel. By concretely doubling, tripling or quadrupling the effective cross section by managing respectively two, three or four strands, and while keeping the maximum output speed as imposed by the last rolling stand, the overall plant output can be proportionally doubled, tripled or quadrupled.

However, several problems arise when a rolling mill has to manage multiple strands in parallel. The main drawback of such configuration is that, when switching from single strand rolling to multiple strand rolling, the equipment downstream of the rolling mill must be adapted to effectively manage a multiplicity of strands in an ordered manner. For instance, when rolling in a slit-mode, a single bar is divided into two bars at a certain moment of the rolling process. The resulting two strands of rolled material can then be rolled in parallel, wherein each strand is strand is guided separately by dry-through conveying channels to a respective spooling station directed by a switching device placed between the rolling mill and the different spooling stations.

At any rate, by rolling in a slit-mode and managing multiple strands in parallel using current technology, even if the hourly production rate is improved, a relatively high number of spooling stations is still needed. Although the slitting technology brings benefits in terms of productivity, the need of additional equipment results in higher spaces required for milling and winding plants.

In general, the number of spooling stations typically required can be up to two times the number of rolled strands, e.g. four spooling stations for two-strand rolling; six spooling stations for three-strand rolling, etc. . . . .

Furthermore, the dry-through conveying channels guiding each of the strands to a respective spooling station are usually made of cast-iron and are therefore considerably heavy and bulky. Ideally, the dry-through conveying channels comprise gentle bends so that the strands can be smoothly guided through the successive rolling stages, thus preventing the strands from being deformed in undesired manner corresponding to the sharp turns. Such a design constraint in the layout of rolling and winding plants evidently implies that a relatively large space is needed for arranging the dry-through conveying channels. A higher number of spooling stations results therefore in a larger area to be dedicated to such dry-though conveying channels.

Consequently, resetting a milling line according to design requirements which are compliant with current slit-mode rolling technology by using the current solutions is still a trade-off between real benefit and return of investment.

Thus, a need exists in the prior art for a winding technology which allows use of a reduced number of spooling stations, both in the case of a substantially single strand rolling process, when a multiplicity of spooling stations are served in succession, each one at a time; and in the case of a multiple strand rolling process, when multiple strands are managed in parallel.

SUMMARY OF THE INVENTION

Accordingly, a major objective of the present invention is to provide a winding machine which allows considerable reduction of the number of required spooling stations.

Moreover, it is a correlated objective of the present invention to minimize the number of required spooling stations to be connected to a given rolling mill set up, both when the rolling mill functions according to an ameliorated single strand mode (e.g. when a multiplicity of single strands are successively delivered to respective spooling stations) and when, instead, the rolling mill manages a multiplicity of concurrent strands (e.g. when a rolling mill functions in a split-rolling mode, producing a multiplicity of parallel strands).

Another objective of the present invention is to provide a flexible solution to managing strands of rolled material which allows, while saving space and minimizing the number of spooling stations required to collect the rolled material into coils, to easily switch between production modes, such as for instance

- traditional single strand rolling;
- ameliorated single strand rolling wherein a multiplicity of strands are consecutively fed to spooling stations;
- slit-mode rolling wherein a multiplicity of strands are concurrently fed to spooling stations to be wound in parallel; or
- otherwise synchronized production modes.

The present invention makes it possible to switch between production modes without having to introduce substantial changes to the winding machinery.

By minimizing the number of spooling stations, the winding machine of the present invention advantageously allows for a proportional reduction of the overall space occupied by winding machinery and distribution lines of rolled strands, in connection with a given upstream production set-up.

Such a space rationalization achieves the desirable result of saving economic resources, both as a direct consequence of occupying less space and also as a result of increased efficiency in carrying out modifications of the production line set-up, for instance following changed production strategies.

BRIEF DESCRIPTION OF THE DRAWINGS

Other objectives, features and advantages of the present invention will be now described in greater detail with reference to specific embodiments represented in the attached drawings, wherein:

FIG. 8, seen vis-à-vis the prior art represented in FIG. 2, shows how winding machines herein allows reduction of spooling stations;

In the figures, like reference numerals depict like elements.

DESCRIPTION OF PRIOR ART

FIGS. 1 to 4 schematically exemplify the function and the structure of current spooling stations where prior art winding machines are used in connection with known rolling mill lines. The representation of prior art winding procedures will help in the following to appreciate the advantages offered by the present invention.

Figure 1:
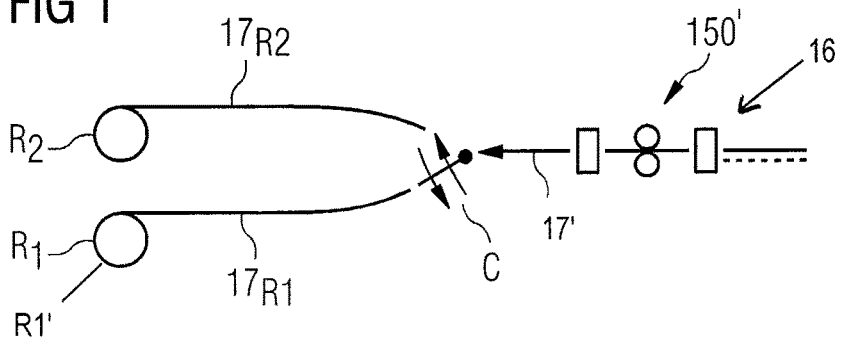
(PRIOR ART) FIG 1
FIG. 1 is a schematic representation of a rolling mill functioning in a single-strand mode and conventionally delivering strands of rolled material alternately to a first spooling station and to a second spooling station. The spooling stations comprise winding machines according to the prior art.

In FIG. 1 a rolling mill 150' substantially functions in a single-strand mode. A single strand 17' of rolled material created out of a first billet 16 is caused to be delivered to a first conventional spooling station R1 by a switch C. After the winding process at spooling station R1 has finished and a corresponding coil R1' has been wound, a second billet 16 is rolled and another single strand 17' of rolled material out of such second billet is delivered to a second conventional spooling station R2 so as to form a second coil R2. Meanwhile, the coil R1' formed at station R1 is removed and the overall plant is ready for a new cycle.

Despite the provision of switch C, a plurality of spooling stations R is needed equal to the number of strands which are wound into coils, for each production cycle as above described, when using conventional winding machines.

Figure 2:
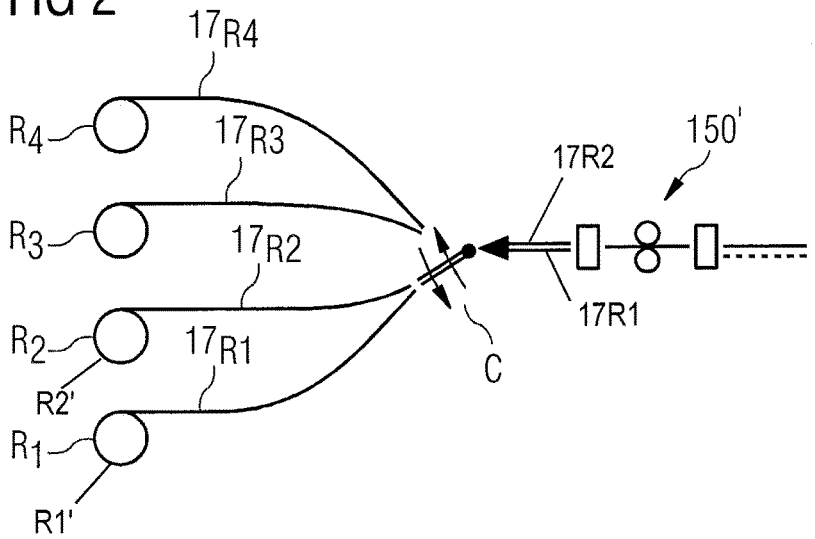
(PRIOR ART) FIG 2
FIG. 2 is a schematic representation of a rolling mill functioning in a slit-mode and conventionally delivering, in parallel, multiple strands of rolled material in turn to a first set of spooling stations and to a second set of spooling stations. The spooling stations comprise winding machines according to the prior art.

FIG. 2 shows a production plant comprising a rolling mill 150' functioning in a slit mode and a multiplicity of spooling stations R1, R2, R3 and R4 with conventional winding machines. Also in this second instance, switch C is provided for diverting strands of rolled material.

Slit mode rolling entails dividing a single bar of material to be rolled into two bars R1 and R2 at a selected stage of the rolling process in the rolling mill. The resulting two strands of rolled material 17R1 and 17R2 are then rolled in parallel. Each strand is separately guided by its own dry-through conveying system. Thus, according to slit mode functioning, multiple strands of rolled material traveling in parallel are in turn delivered to different sets of spooling stations R1-R4, wherein each spooling station set comprises a number of winding machines equal to the abovementioned number of multiple strands of rolled material traveling in parallel.

More specifically with respect to the example of FIG. 2, strand 17R1 and strand 17R2, initially traveling in parallel, are diverted by switching means respectively to a first set of spooling stations R1 and R2. At spooling station R1, a conventional winding machine winds a first coil R1' and at spooling station R2, another conventional winding machine winds a second coil R2'. When these two coils are completed, switch C switches to a different position so that two further two strands 17R3 and 17R4, each deriving from one of two slit bars, are routed respectively to a second set of spooling stations R3 and R4 so that the spooling process can be repeated. Meanwhile, the two coils R1' and R2' formed at stations R1 and R2 can be removed. When the two coils formed at spooling stations R3 and R4 are also ready, the production and winding cycle can be repeated.

In this configuration, an overall number of spooling stations, and consequently of conventional winding machines, is needed which is double the number of strands traveling in parallel and being delivered at a corresponding set of spooling stations, for a given position of the switch means C. That is, for two strands traveling in parallel in a production cycle as above described, overall four winding machines are needed. In the case of a rolling mill functioning in a tri-slit mode, the overall number of spooling stations required in a configuration analogous to the one just described would be six.

Figure 3:
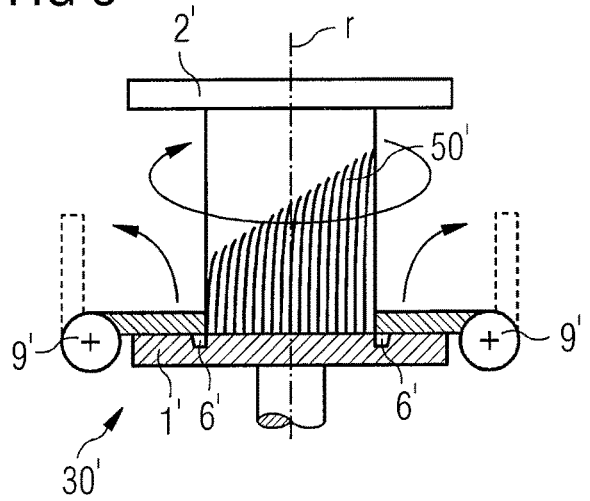
(PRIOR ART) FIG 3
FIG. 3 is a schematic front view representation of a conventional reel in a state of the art winding machine, illustrating two different configurations of strand catching means, respectively during the formation of initial coil turns and after the initial coil turns have been executed.
Figure 4A:
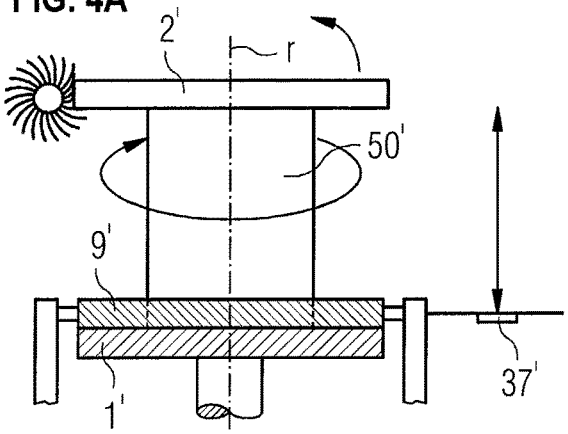
(PRIOR ART) FIG. 4A
FIG. 4A is a schematic representation of the reel of FIG. 3, viewed laterally in FIG. 4A.
Figure 4B:
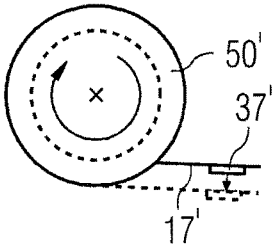
(PRIOR ART) FIG. 4 B
FIG. 4B is a view from a side of FIG. 4A, i.e. a front of FIG. 3, illustrating how a conventional distributor of rolled material feeds a strand thereof to the reel for winding in a conventional winding machine.

This constraint is ultimately a drawback because large spaces are required and high running costs are incurred, linked to the structure of conventional winding machines, as exemplified in FIGS. 3 and 4.

A state of the art winding machine in FIG. 3 typically comprises a reel 50' which is made to rotate around a rotation axis r by the activation of a motor drive (not shown). The winding machine typically also comprises a base flange 1' integral with the reel 50'.

The base flange 1' cooperates with a catching means 30', described below, for securing the end of a strand 17' during a preliminary strand catching process as the initial coil turns are formed around reel 50'. Typically, such catching means 30' take the form of a catching recess 6' in the base flange 1' and of a couple of flaps 9' which are hinged to the winding machine. Flaps 9' are movable between an upraised open position shown in broken line and a closed lowered position shown in solid line. When in the open position, represented in dotted lines, flaps 9' leave the catching recess 6' uncovered during the main winding process, following the formation of the initial coil turns. When instead the flaps are lowered in the closed position, represented in a continuous line, flaps 9' cover the catching recess 6' to form a closed passage for the strand 17', so that an end of the strand 17' remains secured (not shown) in the catching recess 6' during a preliminary catching process, as the initial coil turns are formed. In the closed position, therefore, flaps 9' force the rolled material coming from rod distributor 37' (FIGS. 4A and 4B) in recess 6' until at least one or two coil turns. Thereafter, flaps 9' are move apart from base flange 1'. At this stage, distributor 37' starts moving up and down parallel to the axis r of the reel 50', as exemplified in the side view of FIG. 4, in order to distribute the strand 17' forming layers of coil. Once a layer is completed, distributor 37' moves laterally to build the subsequent coil layer, as represented in the top view of FIG. 4B. The process is repeated until all of the rolled strand 17' is wound into a coil on reel 50'. Subsequently, a mobile cover flange 2' above the reel is lifted in order to let the produced coil be extracted.

DESCRIPTION OF EMBODIMENT OF THE INVENTION

The present invention will be introduced with reference to the schematic representations of FIG. 5 and FIGS. 6, 6A and 6B, wherein a reel 50 of a winding machine 100 according to the present invention is represented.

A winding machine according to the present invention comprises a base flange 1.

Preferably, a winding machine according to the present invention further comprises a mobile cover flange 2 allowing the completed coils to be extracted from the reel 50 once the rolled material has been wound into coils.

Figure 6A:
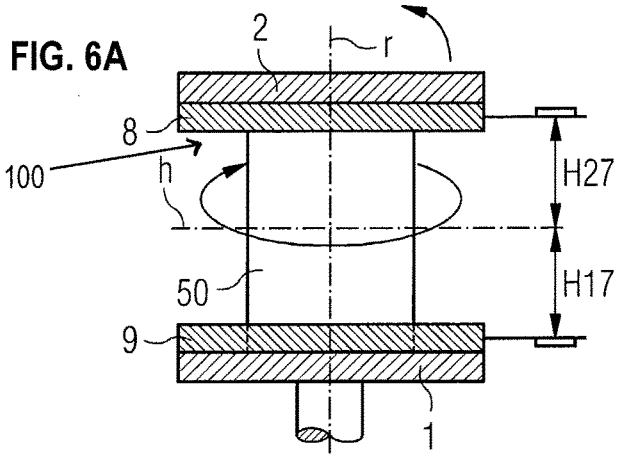
FIG. 6A is a schematic representation of the reel of FIG. 5 when viewed laterally in FIG. 6A.
Figure 6B:
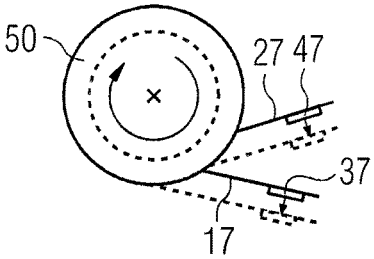
FIG. 6B is a view from a side of FIG. 6A, e.g. a front view of FIG. 6A illustrating how distributors of rolled material feed multiple strands thereof to the reel to be wound in a winding machine according to the present invention.

In a favorite embodiment of the present invention, the above base flange 1 defines a first catching recess 6 which is intended to receive the end of a first strand 17 (FIG. 6B). Such first recess 6 is suitable for securing an end of a first strand 17 during a preliminary catching process as the initial coil turns are formed.

Figure 10:
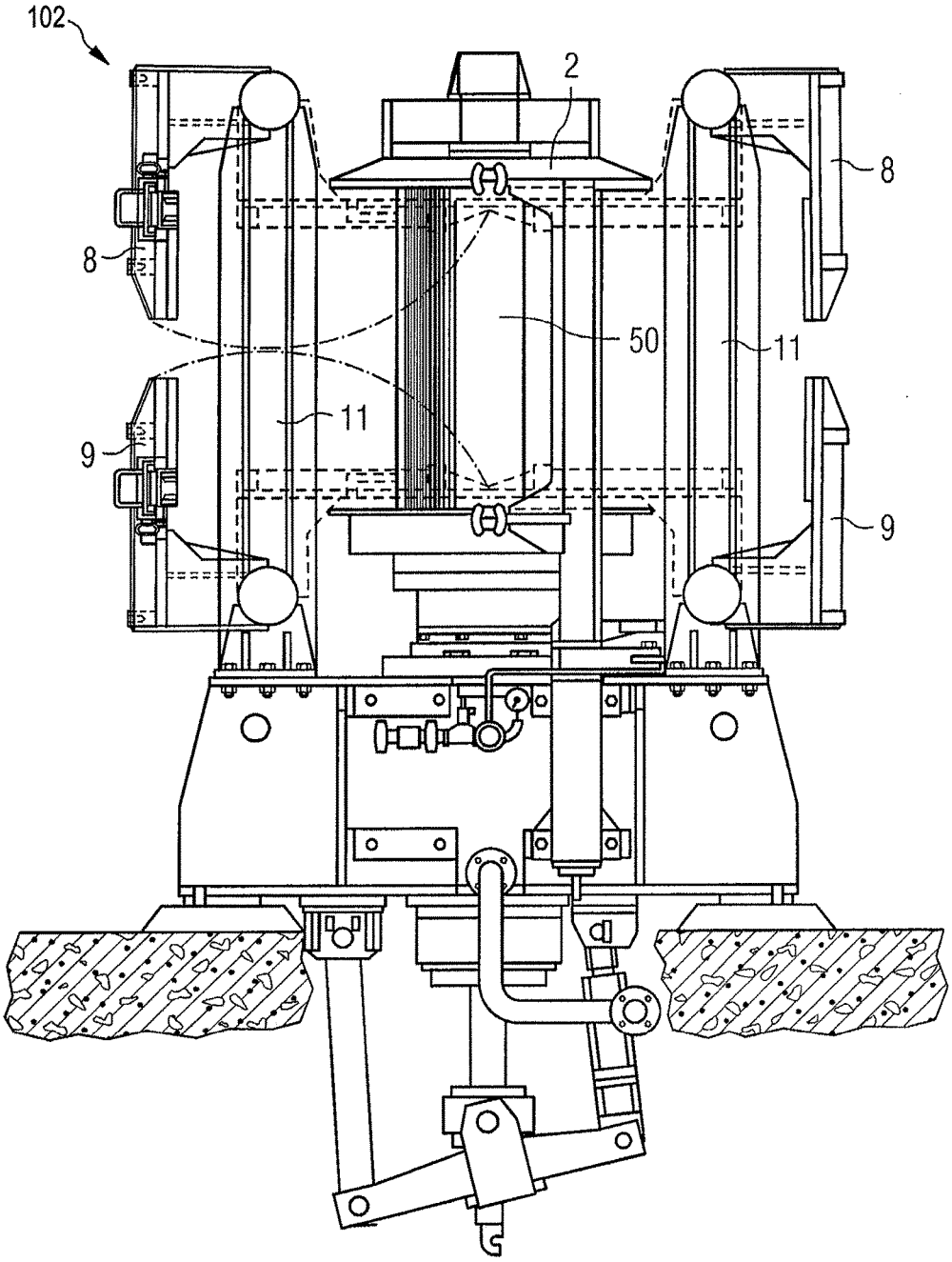
FIG. 10 is a front view of a winding machine according to the present invention.

A winding machine according to the present invention further comprises a first cover 9, or possibly a multiplicity of covers 9. Cover 9 is movably affixed, preferably to the body of the winding machine 100, for instance by way of a hinge mechanism. As is apparent from FIGS. 10 and 13, referring to a preferred embodiment of the present invention, covers 9 can be rotatably mounted onto arms 11 of the winding machine 100.

Cover 9 is thus movable between an open position leaving the first catching recess 6 exposed; and a closed position wherein it covers the first catching recess 6 to form a closed passage for the end of the first strand 17 (See FIG. 6B). Cover 9 is in the open position after the initial coil turns have been executed; whereas it is in the closed position during the formation of initial coil turns when it is required that the strand 17 be firmly grasped.

Figure 5:
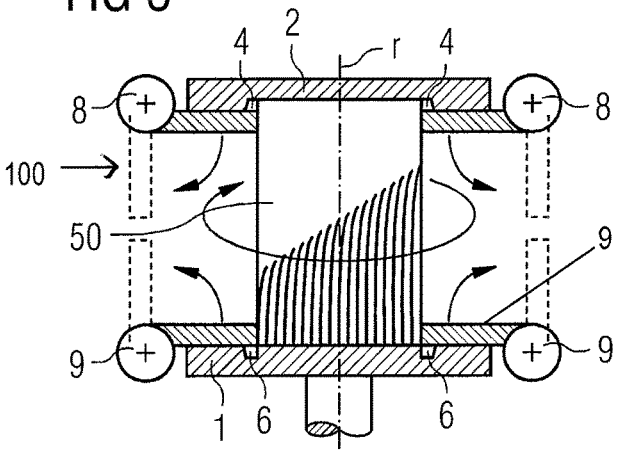
FIG. 5 is a schematic front view representation of a reel in a winding machine according to the present invention, illustrating two different configurations of strand catching means, respectively during the formation of initial coil turns and after the initial coils turns have been executed.

In an especially preferred embodiment, the first catching recess 6 is integral to the base flange 1 (FIG. 5). First catching recess 6 can therefore be a notch or a groove in base flange 1, particularly a circumferential notch or groove on a surface of base flange 1 or on a surface integral thereto.

In addition to the above components and differently from a conventional winding machine, the winding machine 100 according to the present invention comprises at least a second catching element 2 for securing an end of further strands or at any rate at least one further strand, such as strand 27, during a preliminary catching process, as the initial turns of corresponding further coils are formed.

Each second catching element 2 preferably defines a respective second catching element, which is a recess 4.

In a preferred embodiment, the abovementioned mobile cover flange 2 comprises, or is, the second catching element 4.

The winding machine 100 according to the present invention also comprises corresponding further covers which are movable between an open position leaving the further catching recesses exposed and a closed position wherein they cover the further catching recesses to form corresponding catch passages for the ends of the further strands.

Because of this, the first strand 17 together with further strands, such as strand 27, can be rolled to form respective first and further coils on a common reel 50. The present invention thus allows to form a multiplicity of coils on a common reel 50.

Figure 7:
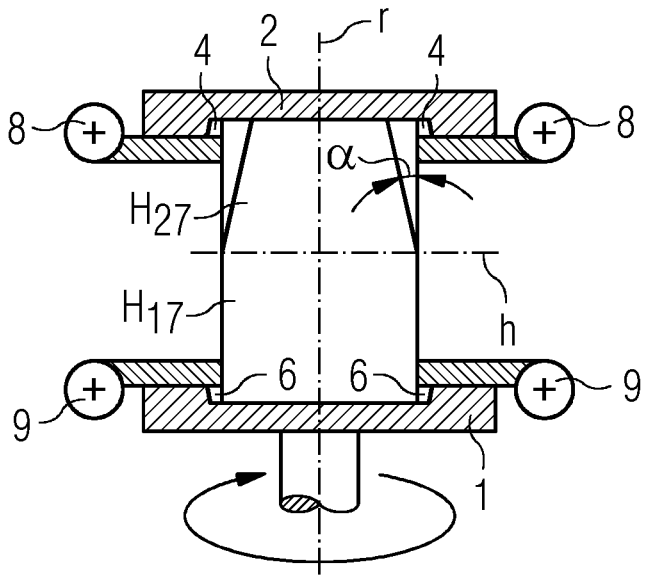
FIG. 7 is a schematic representation of the reel of FIG. 5, wherein the reel is optionally modified to be tapered on a portion of its external surface.

Referring to FIG. 7, in a possible embodiment, the second catching element 4 on the mobile cover flange 2 comprises a single further catching recess 4 and comprises a corresponding further cover 8, or covers 8, movable between an open position leaving the further catching recess 4 exposed and a closed position wherein it covers the further catching recess 4 to form a catch passage for the end of a further strand 27. Such a configuration is ideal for winding one first strand 17 and one second strand 27 into respective two coils on a common reel 50. The function of the cover 8 is mainly to contain the strand 27 of rolled material and force it to stay in the further catching recess 4, acting like a containment wall.

The further catching recess 4 is preferably made integral to the mobile cover flange 2 by the second element 2. More specifically, the further catching recess 4 can be a notch or a groove or an indentation in mobile cover flange 2, particularly an annular or circumferential notch or groove on a surface of mobile cover flange 2. Preferably, the further catching recess 4 is on a surface of the mobile cover flange 2 facing the reel 50. The second element 2 can take the form of a disc which can be made integral with mobile cover flange 2. In other embodiments, such a notch or groove 4 can also be in a further element of the winding machine, for instance directly integrated in the reel or on another catch that engages with the reel, even only provisionally, for a preliminary phase of coiling aimed at securing the strands to the reel 50.

Preferably, in recesses 4, 6 a removable anti-wear insert can be introduced and mounted integral to respective flanges 2 and 1 in order to protect the flanges from the heat and the friction of the rolled strands. Such an anti-wear insert can be replaced after a number of coiling processes and is preferably shaped in a way that retention of the strands in the initial stages of winding is enhanced.

FIGS. 9 to 13 represent in more in detail a spooling station comprising an embodiment of a winding machine 102 according to the present invention. The proposed configuration is optimized for winding two coils, fed by respective strand distributors 37, 47, on one common reel 50.

The man skilled in the art, based on the teachings of the present disclosure, could however easily modify it to have more than two coils wound on the same reel 50 and/or to achieve the winding of multiple coils on the same reel 50 by using one only strand distributor. In the latter case, even one strand distributor, aptly displaced, could suffice when used in sequence to deliver, at subsequent times, a multiplicity of strands at different heights of the reel 50.

The particular embodiment illustrated in FIGS. 9 to 13 is a winding machine 102 for wrapping multiple strands of rolled material around a reel into coils, comprising:

a base flange 1 comprising a first catching recess 6;

a mobile cover flange 2 allowing the coils to be extracted from the reel 50 once the rolled material has been wound into coils;

a first distributor 37 of rolled material feeding a first strand 17 of rolled material into the first catching recess 6;

a first couple of flaps 9 which are movable between an open position leaving the first catching recess 6 uncovered and a closed position wherein they cover the first catching recess 6 to form a closed passage for the first strand 17, so that an end of such first strand 17 remains secured in the first catching recess 6 during a preliminary catching process as the initial coil turns are formed;

and further comprising:

a second catching recess 4 on a mobile cover flange 2;

a second distributor 47 of rolled material feeding a second strand 27 of rolled material into the second catching recess 4; and a second couple of flaps 8 which are movable between an open position leaving the second catching recess 4 uncovered and a closed position wherein they cover the second catching recess 4 to form a closed passage for such second strand 27 so that an end of the second strand 27 remains secured in the second catching recess 4 during a preliminary catching process as the initial coil turns are formed.

Figure 8:
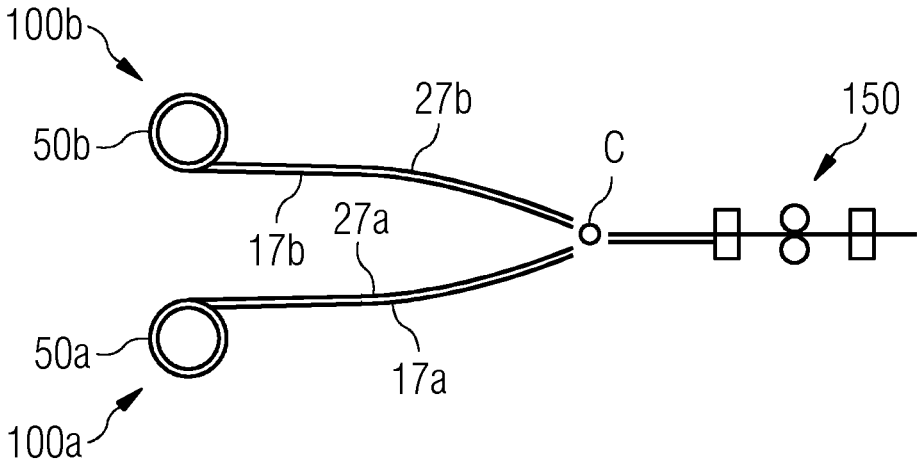
FIG. 8 is a schematic representation of a rolling mill functioning in a slit-mode (analogously to FIG. 2) and delivering, in parallel, multiple strands of rolled material in turn to a first spooling station and to a second spooling station, wherein both such spooling stations comprise winding machines according to the present invention.

In FIGS. 7 and 8 the rolling mill and winding plant are able to manage couples of strands such as 17,27 or 17*a*,27*a* or 17*b*,27*b*, each winding machine according to the present invention guarantees that for each of these couples of strands, a single reel 50 or 50*a* or 50*b* of the winding machine is apt to receive a couple of corresponding coils.

Thus, with reference to the schematizations of FIG. 5 and FIGS. 6 and 6A and in consideration of a set-up where exactly a first coil and a second coil are wound, by a machine 100 according to the present invention, on one reel 50, the second distributor 47 is displaceable with respect to the reel 50 in a way that the second coil is preferably formed by winding the second strand 27 around a corresponding second winding portion H27 of the reel 50 bridging the second element 2 to substantially halfway h the length of the reel 50 along its axis r. Analogously, the first distributor 37 is made displaceable with respect to reel 50 in a way that the first coil is preferably formed by winding the first strand 17 around a corresponding first winding portion H17 of the reel 50 bridging the base flange 1 to substantially halfway h the length of the reel 50 along its axis r.

In the scheme of FIG. 8 the above set-up is applied to a production plant comprising a rolling mill 150 functioning in a slit mode and wherein switching means C is provided for diverting strands of rolled material. The advantages offered by the winding machines according to the present invention vis-à-vis prior art winding machines such as the ones employed in the production plant of FIG. 2 become thus evident.

With reference to FIG. 8, winding machines 100*a*, 100*b* according to the present invention are provided. For each such winding machine 100*a*, 100*b*, a second coil is formed by winding a second strand 27*a*, 27*b* around a corresponding second winding portion H27 of the respective reel 50*a*, 50*b* bridging the respective mobile cover flange 20 to substantially halfway h the length of the respective reel 50*a*, 50*b* along its axis r; whereas a first coil is formed by winding a first strand 17*a*, 17*b* around a corresponding first winding portion H17 of the respective reel 50*a*, 50*b* bridging the base flange 1 to substantially halfway h the length of the respective reel 50*a*, 50*b* along its axis r.

Multiple coils on a same reel 50 can be formed by winding machines according to the present invention substantially at the same time or subsequently.

The covers cooperating with catching recesses to secure the strands can be flaps 8, 9, preferably arranged in respective couples of flaps. Flaps 8, 9 can extend so as to cover substantially the whole length of respective recesses 4, 6; or they can cover the recesses only partially to the extent that the strands remain secured in the recesses during the preliminary coiling phases. Flaps 8, 9 can also overlap with the whole reel-facing surface of the second element 2 and of the first flange 1, respectively, or they can only partially overlap with the latter.

In FIG. 5 the flaps 8, 9 shown in continuous lines are deployed in an operative configuration corresponding to the formation of initial coil turns and in broken lines in an inoperative configuration.

Figure 12:
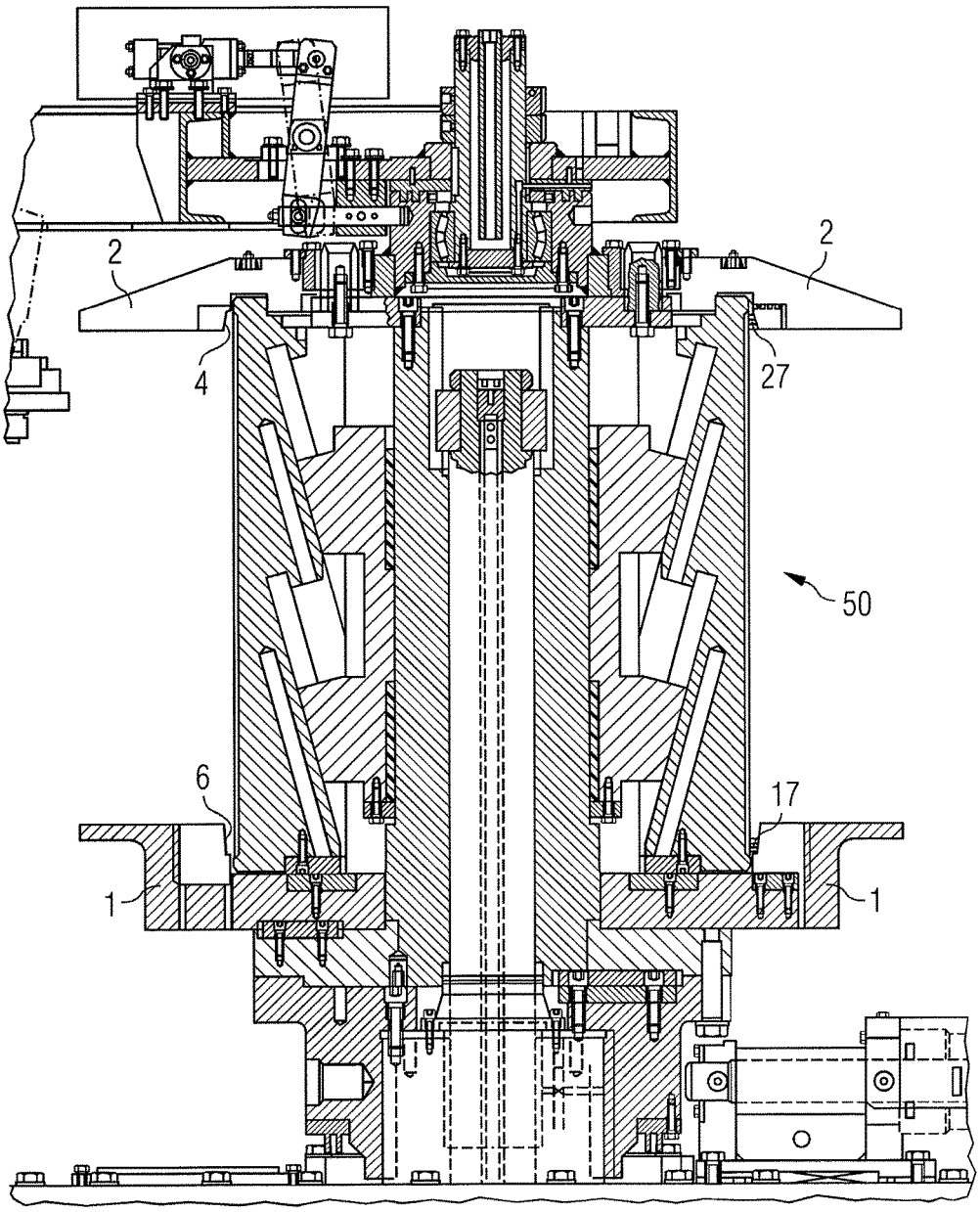
FIG. 12 is a cross-sectional view of a reel in a winding machine according to the present invention in an operative configuration corresponding to the formation of initial coil turns, wherein strand catching means are in part visible to show two coils in respective catching recesses.
Figure 13:
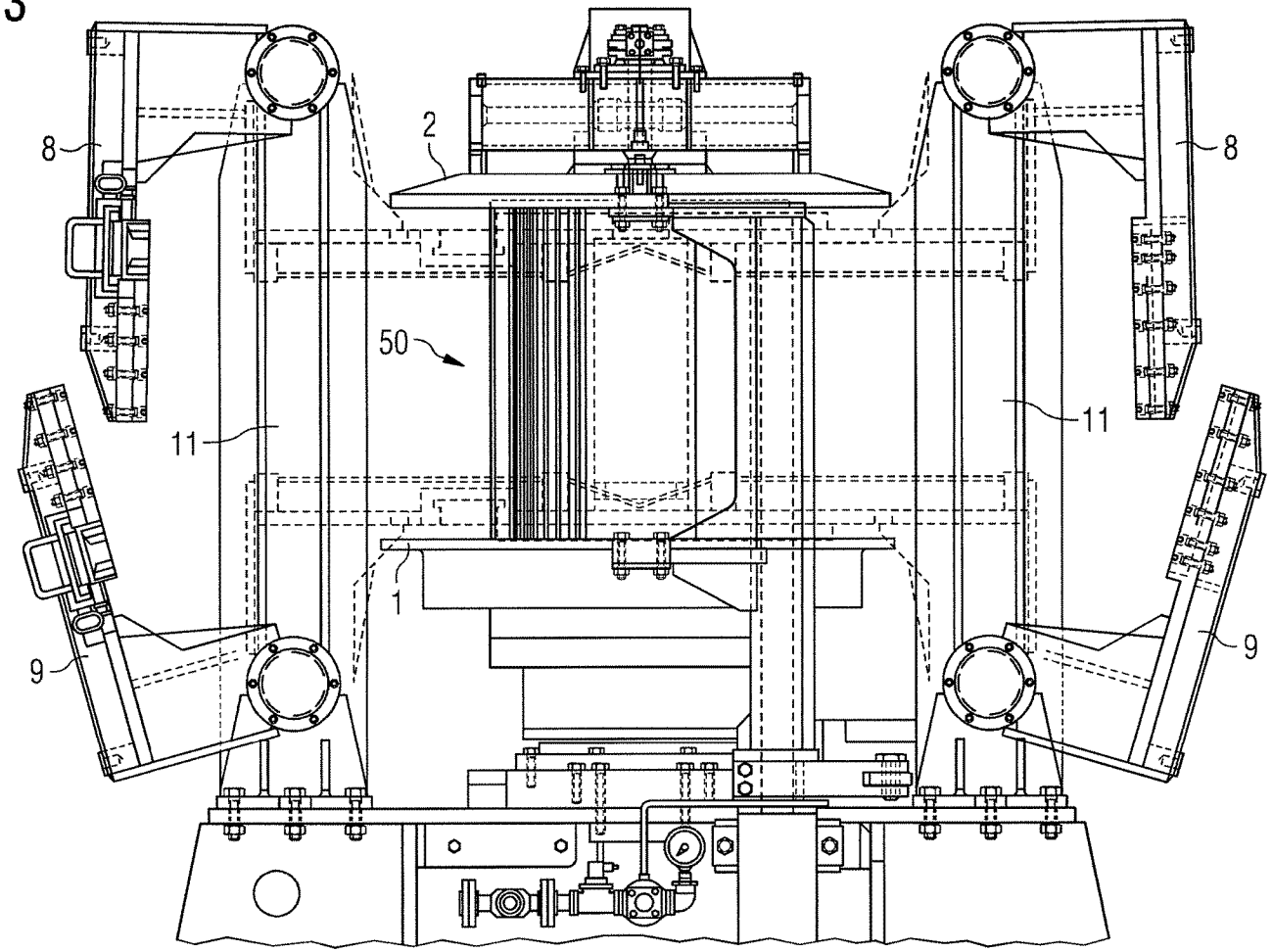
FIG. 13 is a front view of a reel in a winding machine according to the present invention with catching means positioned in an operative configuration corresponding to a more advanced state of the formation of coil turns with respect to that represented in FIG. 12 or alternatively corresponding to a completed or not yet started coiling process.

In FIG. 13 the flaps 8, 9 are deployed in an operative configuration corresponding to an advanced state of the formation of coil turns; or alternatively corresponding to a completed or not yet started coiling process. In FIG. 13 the relative movement of flaps is also highlighted. Flaps 8, 9 can move relative to each other, for instance pivoting around arms 11 of the winding machine 100, without interfering. Flaps 8, 9 are therefore designed so as to not interfere when concomitantly in their open position, the catching process of a first strand such a strand 17 or 17*a* or 17*b* being thus independent from the catching process of a further strand, such as strand 27 or 27*a* or 27*b*. In FIG. 12, where the flaps are not shown, first strand 17 and second strand 27 are represented, respectively caught in catching recesses 6, 4, in an operative configuration immediately following the preliminary formation of initial coil turns, when the flaps have ensured that strands 17 and 27 stay secured in the recesses by promptly covering the recesses so as to form closed passages.

As already mentioned, it is also possible to apply the teachings of the present invention to a production plant repeatedly using only one distributor of rolled material to feed a multiplicity of strands of rolled material into catching recesses 6, 4, so that such strands are rolled to form a respective multiplicity of coils on a common reel 50. In this instance, the distributor needs to feed one strand at a time into respective recesses in a sequence of feeding operations followed by the securing and the winding of each coil. In order to allow this, the distributor needs to be displaceable with respect to the reel, in order to reach in sequence the positions which allow the successive feeding of respective strands. In this configuration, either distributor 37 or distributor 47 can be used.

Figure 9:
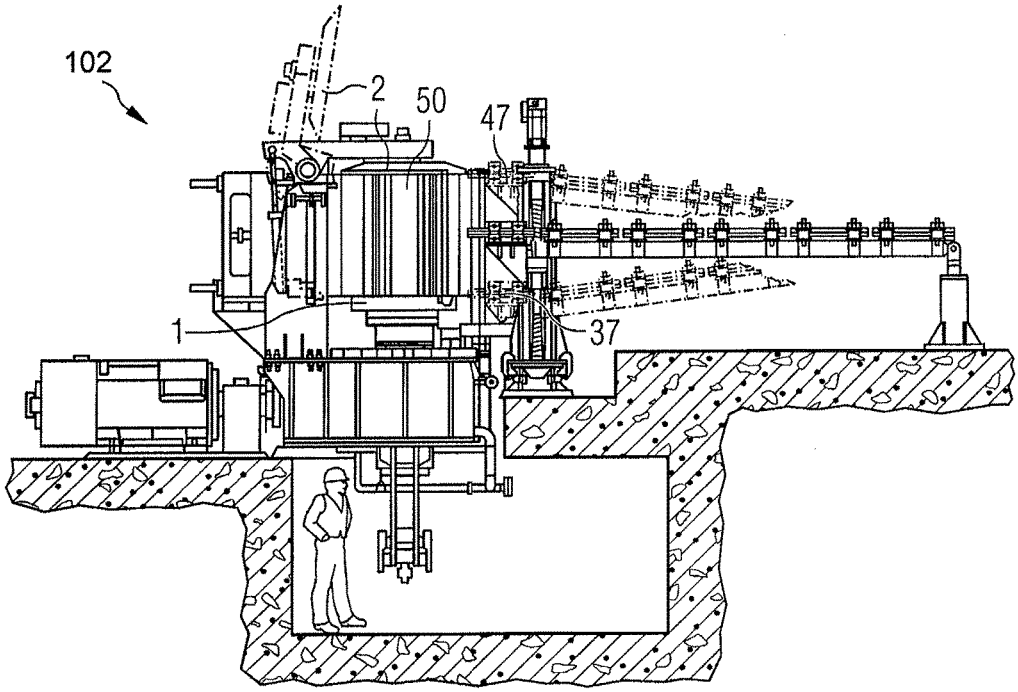
FIG. 9 is a lateral view of a winding machine according to the present invention.
Figure 11:
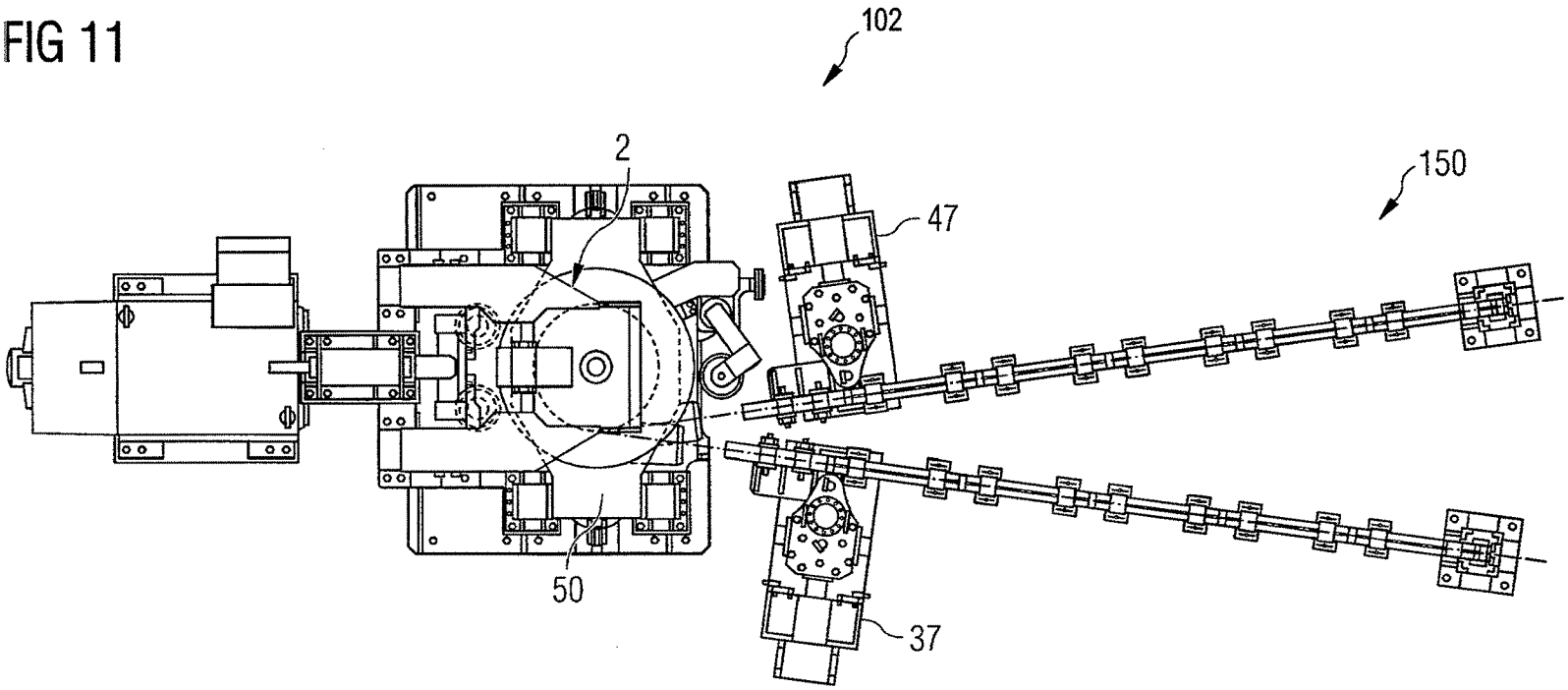
FIG. 11 is a top view of a winding machine according to the present invention.

FIGS. 9 and 11 however disclose an embodiment of the present invention wherein a first distributor 37 of rolled material feeds a first strand 17 of rolled material into a first catching recess 6 and a second distributor 47 of rolled material feeds a second strand 27 of rolled material into a second catching recess 4 for the winding of two respective coils on a common reel 50.

Mutatis mutandis, for the set-up of FIG. 8, winding machines 100*a*, 100*b* comprise distributors 37 of rolled material feeding a respective first strand 17*a*, 17*b* of rolled material into a first catching recess 6 and comprise further distributors 47 of rolled material feeding a respective further strand 27*a*, 27*b* of rolled material into a further catching recess 4.

Distributors 37, 47 can move independently one from the other. As a result, the coils respectively formed on said common reel 50 can be formed independently.

The distributors 37, 47 can be staggered-positioned so as to not interfere in each other's feeding process.

Distributors 37, 47 can be displaced substantially parallel to the longitudinal axis r of the reel 50, spanning over respective portions of such common reel to form successive layers of respective coils.

Thus, in case of two distributors 37, 47 feeding two respective strands 17, 27, all along the coil completion process the first distributor 37 spans over a corresponding first portion H17 of the reel 50 to form successive layers of the first coil and, analogously, the second distributor 47 spans over a corresponding second portion H27 of the reel 50 to complete successive layers of the second coil.

Distributors 37, 47 are also displaceable sideways with respect to reel 50, preferably on a plane substantially perpendicular to the longitudinal axis r of reel 50.

With reference to FIG. 6B and FIG. 9, the first distributor 37 feeds a first strand 17 from the minimum diameter of the inner layer of a first coil to the maximum diameter of the outer layer of a first coil; whereas the second distributor 47 feeds a second strand 27 from the minimum diameter of the inner layer of a second coil to the maximum diameter of the outer layer of the second coil.

Once completed, the coils on one same reel 50 are extracted after opening the mobile cover flange 20, preferably one next to the other as they are produced, and then strapped together.

Preferably, a reel 50 of a winding machine according to the present invention is tapered at its end closest to the mobile cover flange 2, as it is shown in FIG. 7. Such tapered design prevents the coil formed or being formed in the upper winding portion H27 from slipping down on the reel and thus from interfering with the coil formed or being formed in the lower winding portion H17.

The invention claimed is:

1. A winding machine for wrapping strands of a rolled material, around a reel into coils, comprising:

a reel for wrapping the strands thereon;

a base flange on which the reel is supported;

a first catching recess in the base flange open toward the reel and configured to receive an end of a first one of the strands;

a first cover near the first catching recess and movable between a first open position leaving the first catching recess exposed and a first closed position at which the first cover covers the first catching recess to form a first closed passage for the end of the first one of the strands and to secure the end of the first one of the strands to the reel;

a second element spaced from the base flange along an axis of the reel, a second catching recess in the second element open to the reel to receive an end of a second one of the strands;

a second cover movable between a second open position leaving the second catching recess exposed and a second closed position at which the second cover covers the second catching recess to form a second closed passage for the end of the second one of the strands and to secure the end of the second one of the strands to the reel; and one distributor of the rolled material, which is aptly displaced for feeding the first one and the second one of the strands of the rolled material into the first catching recess and the second catching recess, respectively, to enable the first one and the second one of the strands to be wound to form respective first and second coils at different heights on the reel, wherein the opening of the first catching recess and the opening of the second catching recess face toward each other so that the first one of the strands forms the first coil on the reel extending away from the base flange when the first catching recess receives the end of the first one of the strands and the second one of the strands forms the second coil on the reel extending toward the base flange when the second catching recess receives the end of the second one of the strands.

2. A winding machine for wrapping strands of a rolled material, around a reel into coils, comprising:

a reel for wrapping the strands thereon;

a base flange on which the reel is supported;

a first catching recess in the base flange open toward the reel and configured to receive an end of a first one of the strands;

a first cover near the first catching recess and movable between a first open position leaving the first catching recess exposed and a first closed position at which the first cover covers the first catching recess to form a first closed passage for the end of the first one of the strands and to secure the end of the first one of the strands to the reel;

a second element spaced from the base flange along an axis of the reel, a second catching recess in the second element open to the reel to receive an end of a second one of the strands;

a second cover movable between a second open position leaving the second catching recess exposed and a second closed position at which the second cover covers the second catching recess to form a second closed passage for the end of the second one of the strands and to secure the end of the second one of the strands to the reel;

a first distributor of the rolled material located and configured for feeding the first one of the strands of the rolled material into the first catching recess and for forming a first coil of the first one of the strands; and at least one second distributor of the rolled material located and configured for feeding the second one of the strands of the rolled material into the second catching recess for forming a second coil of the second one of the strands, wherein the opening of the first catching recess and the opening of the second catching recess face toward each other so that the first one of the strands forms the first coil on the reel extending away from the base flange when the first catching recess receives the end of the first one of the strands and the second one of the strands forms the second coil on the reel extending toward the base flange when the second catching recess receives the end of the second one of the strands.

3. The winding machine according to claim 2, further comprising a mobile cover flange which is removable from the reel to allow the coils to be extracted from the reel in an axial direction opposite the base and which is positionable on the reel after the rolled material has been wound into coils and extracted from the reel.

4. The winding machine according to claim 3, wherein the reel is tapered toward an end thereof closest to the mobile cover flange.

5. The winding machine according to claim 3, wherein the second catching recess is in the mobile cover flange and opens toward the first catching recess, and the mobile cover flange is the second element.

6. The winding machine according to claim 2, wherein the first and second covers comprise flaps.

7. The winding machine according to claim 6, wherein each of the base flange and the second element is arranged in a respective couple of the flaps.

8. The winding machine according to claim 7, wherein the respective flaps of the first and second covers are opposed, and move open toward each other and move closed away from each other.

9. The winding machine according to claim 2, wherein the first distributor and the at least one second distributor are movable independently, one from the other, such that the first coil and the second coil respectively formed on the reel are independent.

10. The winding machine according to claim 9, wherein the first coil and the second coil are formed independently.

11. The winding machine according to claim 2, wherein the first distributor and the at least one second distributor are staggered-positioned at respective locations so that each distributor does not interfere with a feeding process of the other distributors.

12. The winding machine according to claim 2, wherein the at least one second distributor of the rolled material is displaceable with respect to the reel in a manner such that the second coil is formed by winding the second one of the strands around a corresponding second winding portion of the reel bridging the second element to substantially halfway a length of the reel along an axis of the reel; and the first distributor of the rolled material is displaceable with respect to the reel in a manner such that the first coil is formed by winding the first one of the strands around a corresponding first winding portion of the reel bridging the base flange to substantially halfway the length of the reel along the axis of the reel.

13. The winding machine according to claim 2, wherein the first cover and the second cover are each located and configured to not interfere with each other when the first cover and the second cover are concomitantly in their respective open positions, whereby a catching process of the first one of the strands is independent from a catching process of the second one of the strands.

14. An assembly comprising:

a rolling mill plant; and the winding machine according to claim 2, wherein:

the rolling mill plant is configured to manage a multiplicity of the strands of the rolled material, either simultaneously or in sequence; and the reel of the winding machine is configured to receive a multiplicity of coils corresponding to the multiplicity of the strands.

* * * * *